United States Patent [19]

Romer et al.

[11] 4,153,223

[45] May 8, 1979

[54] LIMITED-RANGE PROJECTILE HAVING A FLAT TRAJECTORY

[75] Inventors: Rudolf Romer, Kaarst; Wolf Trommsdorff, Porz-Grengel; Christian Jaeneke, Aachen, all of Fed. Rep. of Germany

[73] Assignee: Rheinmetall GmbH, Dusseldorf, Fed. Rep. of Germany

[21] Appl. No.: 801,426

[22] Filed: May 27, 1977

[30] Foreign Application Priority Data

Jun. 1, 1976 [DE] Fed. Rep. of Germany ..... 2624524

[51] Int. Cl.[2] ..... F42B 13/00

[52] U.S. Cl. ..... 244/3.1; 244/3.24; 102/92.1; 102/DIG. 10

[58] Field of Search ..... 102/3, 92.1, DIG. 10; 244/3.1, 3.24

[56] References Cited

U.S. PATENT DOCUMENTS 3,532,300 10/1970 Bucklisch et al. ..... 244/3.24

OTHER PUBLICATIONS

Rethorst et al., High Performance Hollow Projectiles, VRC Report No. 26, 8/17/73, pp. 11-19.

*Primary Examiner*—Verlin R. Pendegrass

[57] ABSTRACT

There is disclosed a limited range, high-speed projectile with a flat trajectory. The range is limited by controlling the air resistance of the projectile, so that the air resistance increases markedly when the projectile speed drops below a certain value.

10 Claims, 7 Drawing Figures

LIMITED-RANGE PROJECTILE HAVING A FLAT TRAJECTORY

BACKGROUND OF THE INVENTION

With projectiles for combating armoured targets high initial speed is required with a high flight velocity and the capability of absorbing a high cross-sectional load with minimum air resistance coefficient. Testing such projectiles for development or training has to be performed on rest ranges of limited size and this is made difficult, as the range of the projectiles is considerable. With only small barrel elevations and a flat flight path ricohets may cover large distances beyond the test range. This also applies to "misses."

SUMMARY OF THE INVENTION

The invention relates to a projectile having a stabilizing tail portion through which air passes. The openings in the tail form a supersonic diffuser with a ratio between the incident air flow or capture cross section and the reduced or throat cross section such that above a certain Mach number approach air flow is swallowed. While below a certain critical Mach number a normal compression shock wave is produced in front of the diffuser, so that the approach air flow is no longer swallowed with an accompanying increase in the coefficient of resistance.

DETAILED DESCRIPTION

Figure 2:
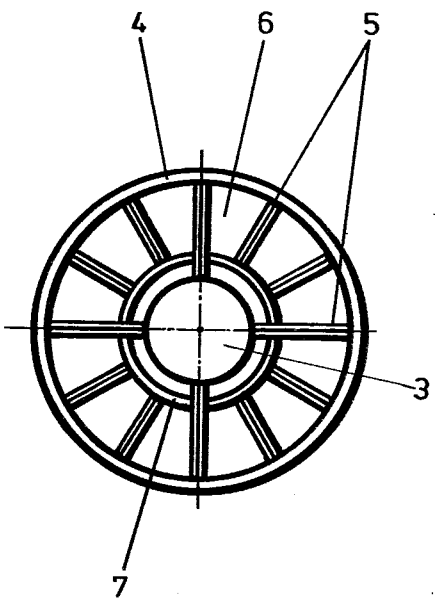
FIG. 2 shows a front view of the projectile shown in FIG. 1.
Figure 1:
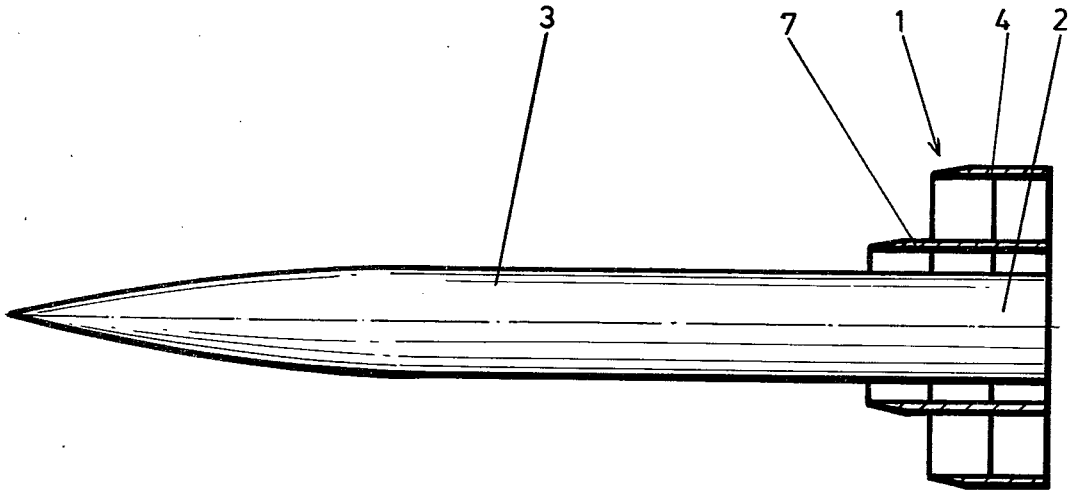
FIG. 1 shows a side view of a projectile according to the invention, showing the tail in section.

In the embodiment of the invention shown in side and front views in FIGS. 1 and 2, the sub-calibre projectile body 3 has the usual arrow shaped form, and the tail section 1 comprises a plurality of winglike members that form channels to control air passage, thus retaining the advantage of wing stabilization characteristic of prior-art projectiles while incorporating the advantages of the present invention. The limited-range feature of the invention is provided by the structure of the wing members or spokes 5.

Figure 3:
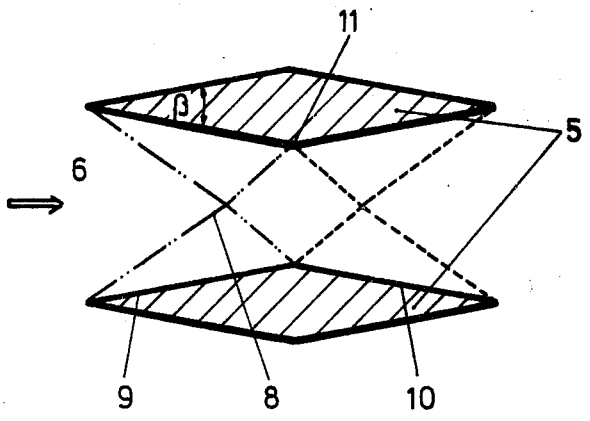
FIG. 3 shows a schematic view of an opening in the tail section through which the air stream flows.

Four of spokes 5 fasten tail 1 to body 3, and the other eight spokes 5 segment the tail into channels 6, which are closed by cylinders 7 and 4, cylinder 7 extending further toward the front than cylinder 4. Cylinders 7 and 4 are of generally uniform thickness with a slight taper to a knife-edge on the outside of the leading edge, as shown in FIG. 1. Spokes 5, as shown in detail in FIG. 3, which shows a section taken through one of channels 6, have a generally diamond-shaped cross section, with an angle $\beta$ on the leading edge forming a supersonic diffusor. The area at the leading edge of channel 6 will be known as the capture cross section, the area between corners 11 of channel 6 will be known as the reduced cross section, and the rear will be known as the exit cross section. As air flows through channel 6 in the direction of the arrow in FIG. 3 with a high approach flow Mach number, the air flow is absorbed between the wings 5, and a system of compression shock waves 8 builds up in the flow. In a diffuser part 9 of the flow channels 6 a low loss compression takes place, whilst in a nozzle-shaped extension 10 a resistance-decreasing expansion occurs.

The air resistance of the tail unit 1, through which the air flows at high supersonic velocity, remains therefore low.

The ratio of the reduced or throat cross section 11 to the incident air flow or capture cross section and the angle $\beta$ determine lowest approach flow Mach number at which the resistance coefficient of the tail unit 1 remains low.

Supersonic flows in such supersonic diffuseres are only stable however when the approach flow Mach number for a certain ratio of the minimum cross section to the interception cross section is sufficiently high. With a correspondingly high Mach number, therefore, the air flowing into the tail unit 1 will be swallowed.

If the flight speed of the projectile becomes slower than the critical Mach number determined by the ratio of the reduced cross section 11 to the capture cross section and angle $\beta$ the flow suddenly alters.

Figure 4:
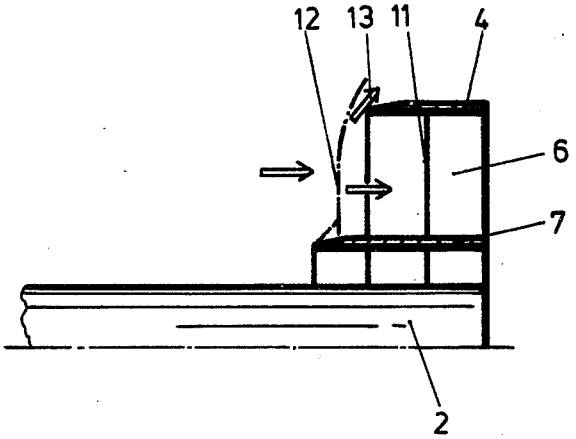
FIG. 4 shows a section view of the tail indicating the air flow at speeds below the predetermined transition speed.

As shown in FIG. 4, a normal compression shock wave 12 occurs in front of the tail unit 1. The air flowing into the channels 6 between the wings 5 is no longer swallowed by the throat 11 of the narrowest part.

As the approaching air can no longer pass through the tail unit 1 at supersonic speed, a flow 13 bypasses the tail unit 1.

Figure 5:
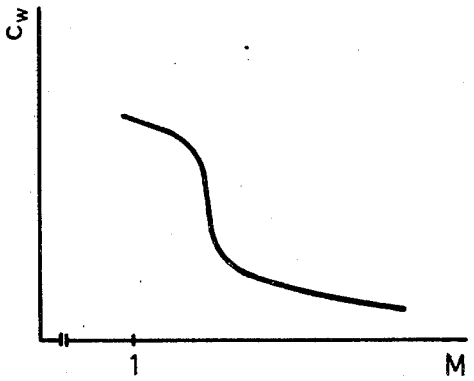
FIG. 5 shows a graph indicating the dependence of the air resistance coefficient of the projectile as a function of speed.

The dimensionless resistance coefficient $C_W$ of the annular tail unit 1 then rises suddenly (FIG. 5).

The effective area that resists the air flow and thus exerts a braking effect in the projectile is proportional to the square of the dimension of tail 1. The increase in the resistance of the projectile is greater than in the known types of projectile having a tubular bore as the ratio of the cross section of the tail unit to that of the projectile itself is greater.

The control of the relationship between air speed and drag disclosed above acts to brake the projectile suddenly, when the speed of the projectile drops to the predetermined value. In turn, the muzzle velocity of the projectile may be preset so that the projectile will travel a desired distance before the nonlinear braking effect sets in. The result of these adjustments is a projectile that travels at high speed within a desired range, and thus reaches the target with the ability to have a large impact, and which projectile also has the easy of aiming afforded by a flat trajectory, but which projectile has a limited range that can be considerably less than the ranges of similar prior-art projectiles similar speeds and trajectories.

It should be noted that cylinder 7 forms an annular boundary layer deflector which ensures that, in the projectile speed range above the change-over point, the undesirably braked boundary layer on the projectile body 3 will not pass into the channels 6 and result in any undesirable effects. But for the sake of a simple tail configuration cylinder 7 may be omitted.

Figure 7:
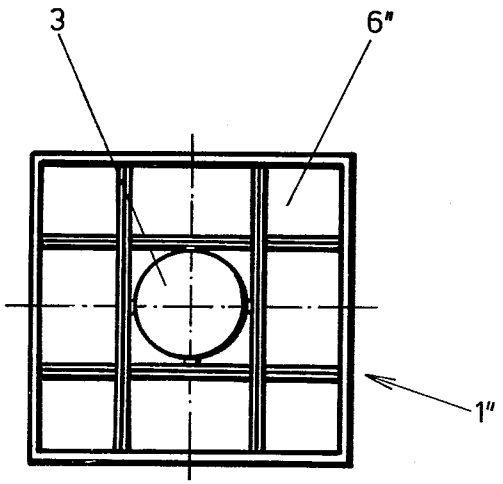
FIG. 6 shows a front view of another embodiment of the invention and FIG. 7 shows a front view of another embodiment of the invention.
Figure 6:
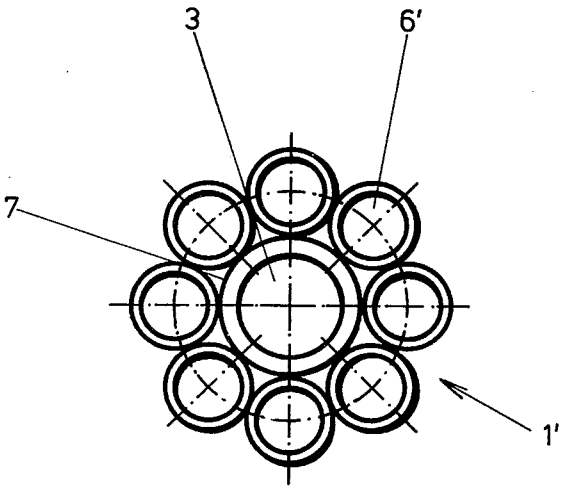

All these features of the invention may be provided by other channel shapes than the trapezoidal channel 6 shown in FIG. 2 FIG. 6 shows a front view of a projectile in which the tail comprises a plurality of tubular members, and FIG. 7 shows a front view of a projectile in which the tail and the individual channels are rectangular. In all cases, channels 6, 6' and 6'' must be constructed according to the invention: the stabilizing tail has channels causing at a certain flight Mach number a choking of the initially supersonic flow through these channels; the ratio of capture cross section to reduced cross section and the leading edge angle must be selected so that high-speed flow is smooth and so that there is a transition to the high-resistance low-flow configuration at a predetermined critical flight speed.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A supersonic projectile having a velocity dependent resistance to air flowing therepast, comprising a body having a front portion and a rear portion forming a stabilizing tail unit, and means for channeling air flowing past said body so that said flowing air travels smoothly through said channeling means when the velocity of said flowing air relative to said body is greater than a predetermined value, and so that said channeling means are choked when said relative velocity is less than said predetermined value, said channeling means comprises a plurality of channels passing therethrough, said channels being positioned about said rear portion of said body forming a stabilizing tail unit, each of said channels having a front opening toward said front portion of said projectile determining a capture cross section, and a rear opening positioned toward said rear portion of said projectile determining an exit cross section, and at least one wall of variable thickness forming said channel by connecting said front opening and said rear opening, which wall of variable thickness is so constructed that an area of reduced cross section is formed between said front opening and said rear opening, whereby the value of said velocity dependent air resistance is substantially greater when said velocity is less than said predetermined value than when said velocity is greater than said predetermined value, thereby air flowing from said front opening through said channeling means and out said rear portion is compressed while passing through said channeling means, this compression being connected with an energy loss, serving to control the velocity dependence of the air resistance of the projectile.

2. A projectile according to claim 1, in which said walls of variable thickness have a leading edge tapering toward said first opening, whereby a leading angle of predetermined value is formed.

3. A projectile according to claim 2, in which said walls of varying thickness have a tapered trailing edge at said rear opening.

4. A projectile according to claim 3, in which said channeling comprises at least two concentric arrays of channels disposed at different distances from said body, the innermost of said arrays having a distance from front opening to rear opening greater than the corresponding distance in the other of said at least two arrays.

5. A projectile to claim 3, in which said channeling means comprises a plurality of channels having circular cross section.

6. A projectile according to claim 3, in which said channeling means comprises a plurality of channels having trapezoidal cross section.

7. A projectile according to claim 3, in which said channeling means comprises a plurality of channels having rectangular cross section.

8. A projectile according to claim 4, in which said channeling means comprises a plurality of channels having a circular cross section.

9. A projectile according to claim 4, in which said channeling means comprises a plurality of channels having trapezoidal cross section.

10. A projectile according to claim 4, in which said channeling means comprises a plurality of channels having rectangular cross section.

* * * * *